United States Patent [19]

Hashimoto et al.

[11] 4,135,928

[45] Jan. 23, 1979

[54] ELECTROPHOTOGRAPHIC LIGHT-SENSITIVE MEMBER

[75] Inventors: Mitsuru Hashimoto, Hino; Masafumi Ohta; Akio Kozima, both of Yokohama, all of Japan

[73] Assignee: Ricoh Co., Ltd., Tokyo, Japan

[21] Appl. No.: 842,485

[22] Filed: Oct. 17, 1977

[30] Foreign Application Priority Data

Oct. 23, 1976 [JP] Japan ..... 51-127720

[51] Int. Cl.[2] ..... G03G 5/04

[52] U.S. Cl. ..... 96/1.5 R; 252/500; 96/1.6

[58] Field of Search ..... 96/1.5, 1.6; 252/500

[56] References Cited

U.S. PATENT DOCUMENTS 3,121,006 2/1964 Middleton et al. ..... 96/1.5

FOREIGN PATENT DOCUMENTS 1337228 11/1973 United Kingdom ..... 96/1.5

*Primary Examiner*—John D. Welsh

*Attorney, Agent, or Firm*—Blanchard, Flynn, Thiel, Boutell & Tanis

[57] ABSTRACT

Electrophotographic light-sensitive member carrying a layer on an electroconductive support, said layer comprising a charge generating substance, a binder and 7-nitro-2-aza-9-fluorenylidene-malonitrile.

5 Claims, 2 Drawing Figures

ELECTROPHOTOGRAPHIC LIGHT-SENSITIVE MEMBER

DESCRIPTION OF THE INVENTION

The present invention relates to a electrophotographic light-sensitive member comprising a charge generating substance and a charge transporting substance.

It is well known that an electrophotographic light-sensitive member used in an electrophotographic process can be obtained by forming a light-sensitive layer (or a photoconductive layer) on an electroconductive support. The light-sensitive layer may be, for example, a layer of amorphous selenium or Se-Te alloy, or a layer comprising a mixture of zinc oxide and insulating resin. The electroconductive support may be a metallic plate, a metal-coated plastic film or electroconductive paper.

The present invention is characterized in that 7-nitro-2-aza-9-fluorenylidene-malonitrile is used as a charge transporting substance, and the object of the present invention is to provide an electrophotographic light-sensitive member having high sensitivity and durability.

In the accompanying drawing, two types of electrophotographic light-sensitive members of this invention are illustrated.

BRIEF DESCRIPTION OF THE DRAWINGS

In the accompanying drawing,

As shown in FIG. 1, an electrophotographic light-sensitive member of the present invention comprises an electroconductive support 1 carrying a light-sensitive layer 2 comprising a charge generating substance, a binder and 7-nitro-2-aza-9-fluorenylidene-malonitrile having the following formula. Alternatively, as shown in FIG. 2, another electrophotographic light-sensitive member of the present invention comprises an electroconductive support 1 carrying the first layer, i.e., a charge generating layer 3 comprising a charge generating substance, and the second layer, i.e., a charge transporting layer 4 comprising a binder and 7-nitro-2-aza-9-fluorenylidene-malonitrile having the following formula:

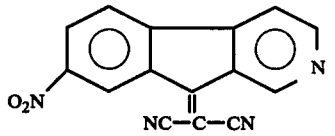

In the present invention, electrophotographic light-sensitive members having excellent electrostatic properties can be obtained by using 7-nitro-2-aza-9-fluorenylidene-malonitrile and a charge generating substance in combination.

The charge generating substances include inorganic substance such as selenium Se-Te alloy, CdS, CdS-Se and the like, or organic pigments, for example, azo-type pigments such as CI Pigment Blue 25 (CI 21180, or Diane Blue 25), CI Pigment Red 41 (CI 21200); xanthene-type pigments such as CI Acid Red 52 (CI 45100); phthalo-cyanine-type pigments such as CI Pigment Blue (CI 74100), β-type copper phthalocyanine; indigo-type pigments such as CI Vat Brown 5 (CI 73410), CI Vat Dye (CI 73030); perylene-type pigments such as Algol Scarlet 13 (sold by Bayer Co., West Germany), Indanthrene Scarlet R (sold by Bayer Co., West Germany); indigoid-type pigments; bis-benzimidazole-type pigments; polynuclear quinone such as violanthrone.

7-nitro-2-aza-9-fluorenylidene-malonitrile is known and commercially available.

The electroconductive support may be a metallic plate such as an aluminum plate or stainless steel plate, an alunimum foil, an aluminum-coated plastic film or electroconductive paper. The binder may be insulating organic high molecular compounds such as polyamide, polyester, polyurethane, polystyrene, polycarbonate, polyvinyl formal, polyvinyl acetal, polyvinyl butyral, ethyl cellulose, nitrocellulose, acetylcellulose, epoxy resin, alkyd resin, acrylic resin, and silicone resin. Further, poly-N-vinyl-carbazole may be used as a binder.

Figure 1:
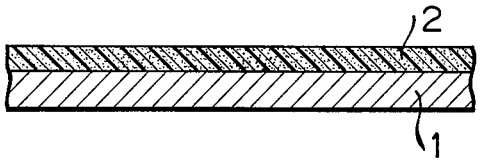
FIGS. 1 and 2 are vertical sectional views through electrophotographic light-sensitive members embodying the present invention. These figures show the thicknesses of the support and the light-sensitive layer thereon enlarged as compared with their actual thicknesses, for the sake of clarity of illustration.

An electrophotographic light-sensitive member as shown in FIG. 1 can be prepared as follows:

A dispersion is prepared by mixing a charge generating substance and 7-nitro-2-aza-9-fluorenylidene-malonitrile in a solution obtained by dissolving a binder in a solvent such as tetrahydrofuran, and the dispersion is applied on an electroconductive support 1 to form a light-sensitive layer 2.

Figure 2:
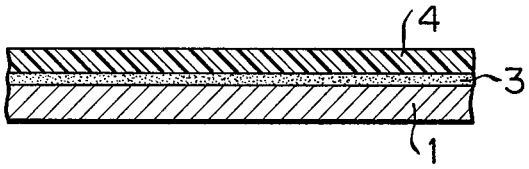

The electrophotographic light-sensitive member as shown in FIG. 2 can be prepared as follows:

A charge generating layer 3 is formed on an electroconductive support 1 by evaporating or applying a charge generating substance or a mixture of a charge generating substance and a binder, and then a charge transporting layer 4 is formed by applying a mixture of a binder and 7-nitro-2-aza-9-fluorenylidene-malonitrile.

In the electrophotographic light-sensitive member as shown in FIG. 1, a charge generating substance is contained in an amount of 0.1 to 30% by weight in the light-sensitive layer 2, and 7-nitro-2-aza-9-fluorenylidene-malonitrile is contained in an amount of 1 to 60% by weight. Further, a conventional sensitizer may be contained in the light-sensitive layer. The thickness of the light-sensitive layer may be 5 to 100 μ.

In the electrophotographic light-sensitive member as shown in FIG. 2, the binder in the charge generating layer 3 is preferably contained in a small amount, and the thickness of the charge generating layer 3 may be 0.05 to 20 μ, preferably 0.1 to 5 μ. 7-nitro-2-aza-9-fluorenylidene-malonitrile is contained in an amount of 20 to 60% by weight in the charge transporting layer 4, and the thickness of the charge transporting layer 4 may be 5 to 100 μ. Further, a conventional sensitizer may be contained in the charge generating layer or the charge transporting layer.

In the electrophotographic light-sensitive member, the adhesion of the light-sensitive layer or the charge generating layer to the electroconductive support can be improved by forming a layer of resin such as polyamide, polyvinyl acetate, polyurethane and the like or a layer of aluminum oxide in a thickness of 0.01 to 1 μ on the electroconductive support. Further, in this manner, the charging property of the electrophotographic light-sensitive member can be improved to some extent.

The electrophotographic light-sensitive member prepared as shown above has high sensitivity to light and high durability in repetitions of the charging and the exposing to light steps.

DESCRIPTION OF THE PREFERRED EMBODIMENTS

The invention is illustrated by the following examples wherein parts are by weight and "electrophotographic light-sensitive member" sometimes is referred to as "light-sensitive member".

EXAMPLE 1

A dispersion containing a charge generating substance was prepared by mixing two parts of Diane Blue (CI 21180) with 98 parts of tetrahydrofuran in a ball mill. This dispersion was applied on an aluminum-coated polyester film by a doctor blade and then dried to form a charge generating layer in a thickness of 1 $\mu$ on the film.

A solution containing a charge transporting substance was prepared by mixing one part of 7-nitro-2-aza-9-fluorenylidene-malonitrile, four parts of polycarbonate (sold by Teijin Co. under the tradename of Panlite L) and 45 parts of tetrahydrofuran. This solution was applied on the charge generating layer by a doctor blade and then dried at a temperature of about 100° C for 30 minutes to form a charge transporting layer in a thickness of 9 $\mu$ on the charge generating layer. In this way, an electrophotographic light-sensitive member No. 1 of the present invention was obtained.

The sensitivity of the light-sensitive member obtained above was evaluated by means of using a testing machine, which is Paper Analyser SP 428 sold by Kawaguchi Denki K.K., as follows:

The light-sensitive member No. 1 was positively charged by a corona discharge of about +6kV, and after it was allowed to stand in the dark for 20 seconds, the surface potential (Vpo) was measured. Then, the charged light-sensitive member was exposed to a tungsten filament lamp whose illuminance at the surface of the light-sensitive number was adjusted to be 20 lux. The time (seconds) required to reduce the surface potential to one half of the starting surface potential was measured. The amount of exposure required to reduce the surface potential to one half ($E_{\frac{1}{2}}$) is calculated by "20 lux x time (seconds)".

Vpo and $E_{\frac{1}{2}}$ of the light-sensitive member No. 1 were as follows:

| Vpo(V) | $E_{\frac{1}{2}}$(lux.second) |
|---|---|
| +790 | 70 |

For the comparison, a control electrophotographic light-sensitive member No. 1-1 was prepared by repeating the same procedure as that described above except that 7-nitro-2-aza-9-fluorenylidene-malonitrile was not used, and the light-sensitive member No. 1-1 was subjected to charging and exposing to light. However, in this light-sensitive member, light discharge (discharge on exposure to light) cannot be observed.

EXAMPLE 2

A dispersion was prepared by mixing three parts of Diane Blue (CI 21180), 40 parts of poly-N-vinylcarbazole (sold by BASF Co. under the tradename of Luvican M 1.70), 10 parts of 7-nitro-2-aza-9-fluorenylidene-malonitrile and 390 parts of tetrahydrofuran in a ball mill. This dispersion was applied on an aluminum-coated polyester film and then dried at a temperature of 100° C for 30 minutes to form a light-sensitive layer in a thickness of 12 $\mu$. In this way, an electrophotographic light-sensitive member No. 2 of the present invention was obtained.

After the light-sensitive member No. 2 was charged at +6kV or −6kV by a corona discharge, using the same means as that of Example 1, Vpo and $E_{\frac{1}{2}}$ were measured in the same manner as that of Example 1 and the results were obtained as shown below:

| Charging | Vpo(V) | $E_{\frac{1}{2}}$(lux.second) |
|---|---|---|
| +6kV | +790 | 8 |
| −6kV | −800 | 25 |

For the purpose of comparison, a control electrophotographic light-sensitive member No. 2-2 was prepared by repeating the same procedure as that described above except that 7-nitro-2-aza-9-fluorenylidene-malonitrile was not used, and then Vpo and $E_{\frac{1}{2}}$ were measured in the same manner as that described above. The results shown below were obtained:

| Charging | Vpo(V) | $E_{\frac{1}{2}}$(lux.second) |
|---|---|---|
| +6kV | +720 | 10 |
| −6kV | −580 | 30 |

EXAMPLE 3

Selenium was vacuum-evaporated on an aluminum plate having a thickness of about 300 $\mu$ to form a charge generating layer in a thickness of 1 $\mu$ on the plate, and then a solution containing a charge transporting substance as shown below was applied on the charge generating layer by a doctor blade, and dried in an atomsphere and then under reduced pressure to form a charge transporting layer in a thickness of 10 $\mu$. The solution containing a charge transporting substance had been prepared by mixing two parts of 7-nitro-2-aza-9-fluorenylidene-malonitrile, three parts of polyester (sold by E.I. du Pont de Nemours & Co. under the tradename of Polyester Adhesive 49000) and 45 parts of tetrahydrofuran.

In the same way described above, an electrophotographic light-sensitive member No. 3 was prepared, and then Vpo and $E_{\frac{1}{2}}$ were measured in the same manner as that of Example 1 and the results shown below were obtained:

| Vpo(V) | $E_{\frac{1}{2}}$(lux.second) |
|---|---|
| +900 | 35 |

For the purpose of comparison, a control electrophotographic light-sensitive member No. 3-1 was prepared by repeating the same procedure as that described above except that 7-nitro-2-aza-9-fluorenylidene-malonitrile was not used, and then the light-sensitive member No. 3-1 was subjected to charging and exposing to light. However, in this light-sensitive member, light-discharge cannot be observed.

EXAMPLE 4

One part of $\beta$-type copper phthalocyanine and 158 parts of tetrahydrofuran were mixed in a ball mill, and to the mixture were added and mixed 12 parts of 7-nitro-2-aza-9-fluorenylidene-malonitrile and 18 parts of polyester (Polyester Adhesive 49000) to prepare a dispersion. This dispersion was applied on an aluminum-coated polyester film by a doctor blade and then dried at a temperature of 100° C for 30 minutes to form a light-senstive layer in a thickness of 16 μ. In this way, an electrophotographic light-sensitive member No. 4 was obtained, it was negatively charged by using the same means as that of Example 1, and Vpo and $E_{\frac{1}{2}}$ were measured in the same manner as that of Example 1 and the results shown below were obtained:

| Vpo(V) | $E_{\frac{1}{2}}$(lux.second) |
|---|---|
| −600 | 15 |

For the purpose of comparison, a control electrophotographic light-sensitive member No. 4-1 was prepared by repeating the same procedure as that described above except that 7-nitro-2-aza-9-fluorenylidene-malonitrile was not used, and then Vpo and $E_{\frac{1}{2}}$ were measured in the same manner as that described above and the results shown below were obtained:

| Vpo(V) | $E_{\frac{1}{2}}$(lux.second) |
|---|---|
| −850 | 25 |

We claim:

1. An electrophotographic light-sensitive member comprising an electroconductive support, a layer on said electroconductive support, said layer comprising a charge generating substance, a binder and 7-nitro-2-aza-9-fluorenylidene-malonitrile having the following formula:

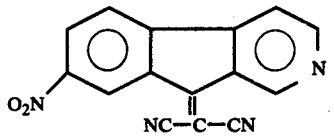

2. An electrophotographic light-sensitve member comprising an electroconductive support, a first layer on said support, said first layer comprising a charge generating substance, a second layer on said first layer, said second layer comprising a binder and 7-nitro-2-aza-9-fluorenylidene-malonitrile having the following formula:

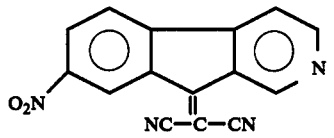

3. An electrophotographic light-sensitive member according to claim 1 or 2 wherein said charge generating substance is at least one substance selected from the group consisting of selenium, Se-Te alloy, CdS, CdS-Se, azo-type pigments, xanthene-type pigments, phthalocyanine-type pigments, indigo-type pigments, perylene-type pigments, indigoid-type pigments, bis-benzimidazole-type pigments and polynuclear quinone.

4. An electrophotographic light-sensitive member according to claim 1 or 2 wherein said binder is at least one binder selected from the group consisting of polyamide, polyester, polyurethane, polystyrene, polycarbonate, polyvinyl formal, polyvinyl acetal, polyvinyl butyral, ethyl cellulose, nitrocellulose, acetylcellulose, epoxy resin, alkyd resin, acrylic resin, silicone resin and poly-N-vinylcarbazole.

5. An electrophotographic light-sensitive member according to claim 1 or 2 wherein a layer of resin selected from the group consisting of polyamide, polyvinyl acetate and polyurethane or a layer of aluminum oxide having a thickness of 0.01 to 1 μ is located between said electroconductive support and the layer containing said charge generating substance.

* * * * *